US006406271B1

(12) United States Patent
Valentin

(10) Patent No.: US 6,406,271 B1
(45) Date of Patent: Jun. 18, 2002

(54) SWASHPLATE TYPE AXIAL-PISTON PUMP

(76) Inventor: Ingo Valentin, 14900 Westover Rd., Elm Grove, WI (US) 53122

( * ) Notice: Subject to any disclaimer, the term of this patent is extended or adjusted under 35 U.S.C. 154(b) by 0 days.

(21) Appl. No.: 09/306,028

(22) Filed: May 6, 1999

(51) Int. Cl.[7] ..... F04B 1/12
(52) U.S. Cl. ..... 417/269; 91/499
(58) Field of Search ..... 417/269; 91/499, 91/488

(56) References Cited

U.S. PATENT DOCUMENTS

| | | | | |
|---|---|---|---|---|
| 3,216,333 A | | 11/1965 | Bellevueweg | 92/110 |
| 3,263,623 A | | 8/1966 | Alexanderson | 103/162 |
| 3,444,690 A | | 5/1969 | Henry-Biabaud | 60/53 |
| 3,521,532 A | | 7/1970 | Espig et al. | 92/57 |
| 3,733,970 A | | 5/1973 | Bosch | 91/506 |
| 3,787,128 A | * | 1/1974 | Maistrelli | 403/135 |
| 4,108,048 A | * | 8/1978 | Gauss et al. | 91/499 |
| 4,129,063 A | | 12/1978 | Ifield | 91/506 |
| 4,167,895 A | * | 9/1979 | Rubinstein | 91/506 |
| 4,174,684 A | * | 11/1979 | Roseby et al. | 123/48 B |
| 4,615,257 A | | 10/1986 | Valentin | 91/499 |
| 4,776,259 A | | 10/1988 | Takai | 92/71 |
| 4,893,548 A | * | 1/1990 | Kawahara et al. | 91/499 |
| 5,011,377 A | * | 4/1991 | Sagawa et al. | 417/269 |
| 5,046,403 A | | 9/1991 | Reidhammer | 92/57 |
| 5,086,689 A | * | 2/1992 | Masuda | 417/269 |
| 5,372,446 A | * | 12/1994 | Chamberlin | 403/122 |
| 5,392,693 A | * | 2/1995 | Engel et al. | 92/248 |
| 5,556,262 A | | 9/1996 | Achten et al. | 417/364 |

FOREIGN PATENT DOCUMENTS

| | | |
|---|---|---|
| DE | 1954565 | 5/1971 |
| GB | 983310 | 2/1965 |
| SU | 1421-894 A | 9/1988 |
| SU | 1463-951 A | 3/1989 |

* cited by examiner

*Primary Examiner*—Cheryl J. Tyler
(74) *Attorney, Agent, or Firm*—Reinhart, Boerner Van Deuren s.c.

(57) ABSTRACT

An axial-piston pump includes a rotatable cylinder barrel having pistons extending from piston bores formed at one end thereof, each piston connected to a shoe by snap-fit joint. A groove/throttle arrangement at the joint provides controlled fluid, depending on its angle of flexion. A spherical, concave swashplate, includes an inclined surface and a spherical, internally form-locked retaining mechanism with two degrees of freedom for engaging and reciprocating the pistons upon rotation of the cylinder barrel. A valve plate, adjacent the end of the cylinder barrel furthest from the swashplate, controls the ingress and egress of the fluid from the piston bores through channels which are tilted towards the centerline and in circumferential direction, reducing the velocity and turbulence of the flow and counterbalancing a tilting moment at the cylinder barrel. The valve plate contains pressure compensating ports to reduce compression losses and delay the pressure adaptation. The swashplate swivels about two axes such that the piston intake stroke begins at top dead-center.

57 Claims, 11 Drawing Sheets

SWASHPLATE TYPE AXIAL-PISTON PUMP

BACKGROUND OF THE INVENTION

This invention relates generally to swashplate type axial-piston hydraulic pumps, and in particular to innovations which increase the efficiency, adjustment range and speed capability and reduce the noise, size, weight and cost of such pumps.

Swashplate type axial-piston hydraulic pumps are well known in the art and typically include a generally cylindrical cylinder barrel rotatably mounted within a pump housing. One or more pump piston bores, having pump pistons reciprocably mounted therein, are disposed around the rotational axis of the cylinder barrel in parallel, or almost parallel alignment therewith. The ends of the pistons project beyond the end of the cylinder barrel so as to engage the surface of an angled swashplate stationarily mounted adjacent the end of the cylinder barrel within the pump housing. When the cylinder barrel is rotated within the housing, shoes, mounted to the piston ends, follow the surface of the angled swashplate with the result that the pistons are reciprocated within their respective piston bores. A valve plate, disposed adjacent the end of the cylinder barrel furthest from the swashplate, controls the ingress and egress of hydraulic fluid from the piston bores such, that a pumping effect is produced in response to rotation of the cylinder barrel within the pump housing.

Although highly advantageous in various applications, swashplate type axial-piston pumps are presently somewhat inefficient and their operational adjustment and speed range is too narrow when used e.g. as a vehicle transmission. (The adjustment range being the ratio of maximum to minimum swashplate angle which can be used efficiently). In addition, hydraulic pumps are generally too large, heavy and noisy at high power throughput and costly.

The inefficiencies are caused by friction due to high mechanical contact forces and leakage. These forces are representing mechanical loads like the side forces between piston and piston bore, retainer plate and shoe and retainer plate and retainer ring, or they are rest forces of loads which are hydrostatically balanced like the forces between shoe and swashplate, in the joint of the shoe and piston and cylinder barrel and valve plate. Furthermore, the friction force components of the mechanical contact forces produce tilting or cocking especially between the shoe and swashplate and the cylinder barrel and valve plate. Components of the piston side forces will increase the tilting between the cylinder barrel and the valve plate. These movements result in noticeable leakage and wear.

Attempts have been made to reduce the tilting or cocking of the cylinder barrel by applying counter forces which balance or nearly balance the tilting moment. Henry-Biabaud (U.S. Pat. No. 3,444,690) tries to balance axial forces and side forces of the floating spherical distributor/valve plate with radial forces of a reduction gear, located at the outer periphery of the cylinder barrel.

Further attempts have been made to reduce the tilting by supporting the cylinder barrel through a bearing located in the plane of the piston side forces on the shaft. The pulsating, resulting piston side force results in radial vibration of the shaft and therefore high frequency, small amplitude tilting of the cylinder barrel at the valve plate, creating additional leakage and wear.

Several prior attempts have been made to overcome the tilting and cocking of the shoe in relation to the face of the swashplate resulting in leakage and wear. The friction in the joint prevents the shoe from adapting fully to the face of the swashplate. A slight tilting is required, resulting in an excentricity of the mechanical force at the face of the shoe which overcomes the moment of friction in the joint These attempts to reduce the required moment and therefore the degree of tilting are directed toward the reduction of friction forces in the piston joint and increased countermoments through excentric hydraulic and mechanical forces at the face of the shoe and mechanical forces at the backface of the shoe due to a spring loaded or form locked retaining mechanism.

Previous attempts to reduce the moment of friction at the joint have lead to the increase of the pressure field within the joint to reduce the mechanical contact force by increasing the hydrostatic force, or to minimize the ball diameter with high friction forces on a small lever arm. Both solutions have had only limited success. The moment of friction on a small ball, limited by a sufficient encirclement of the socket around the ball, typically 20 or more past the geometric center of the ball, and the neck diameter between ball and piston, remains high, and a ball, noticeably larger than the piston diameter, providing space for a sufficient pressure field to reduce the mechanical contact forces, cannot be received deeper into the piston bore, therefore creating noticeable higher piston side forces or a reduced swashplate angle due to a longer lever arm between piston joint and piston bore.

Several prior art attempts have been made to create a sufficient excentric force at the face of the shoe to overcome the moment of friction of the piston joint to avoid or reduce the tilting of the shoe. This has been achieved through a not fully hydrostatically balanced axial shoe force creating a mechanical contact force, acting on the face diameter of a slightly tilted shoe, or through hydrostatic forces created through several pressure fields larger than needed which are partially depressurized due to the tilting of the shoe, creating an off-center hydraulic force. (Pat. SU 1421-894-A1). Various previous attempts have been made to provide these fields with a sufficient amount of fluid and pressure without producing an excessive amount of leakage, instability of the shoe movement, difficulties in fabricating the throttle arrangements and high sensitivity to wear or contamination. (Thoma, UK Pat. 983.310; Pat. SU 1463-951-A).

Both methods to create a counter moment to the friction moment at the joint do not produce the changing counter forces, needed at various swashplate angles and rotational positions during each revolution. Therefore, the remaining rest force or hydraulic forces are oversized at smaller swashplate angles and result in additional losses. The effects of the retaining mechanism are stated later.

Several attempts have been made to reduce the leakage and wear sensitivity at the shoe. Deflecting ends at the face of the shoe have been utilized to provide a hydrodynamic pressure field, thus reducing the size and leakage of the required hydrostatic pressure field. (Espig et al, U.S. Pat. No. 3,521,532). High strength materials for the shoe, such as steel, have been utilized with enclosed bearing material at the face of the shoe to reduce deterioration during service. (Alexanderson et al, U.S. Pat. No. 3,263,623). In both attempts, the shoe socket end is fitted over the ball at the piston by 230 or more.

Prior attempts to reduce the frictional losses between piston and piston bore have been directed toward establishing hydrodynamic or hydrostatic pressure fields at the contact areas. The variants have typically been the clearance between piston and piston bore and the elasticity and/or shape of the ends of the piston bores to improve the conditions for a hydrodynamic pressure field or to establish a hydrostatic pressure field. (Thoma, U.S. Pat. No. 3,216, 333).

Additional losses occur due to mechanical preloads (spring force) between the cylinder and the valve plate and the retaining mechanism, shoe and swashplate. The spring load is needed to hold the parts in position at no or very low pressure rates and to provide additional forces at the back face of the shoe to reduce its tilting. The pre-load forces are generally constant and result in high percentile losses at low pressure rates and small swashplate angles.

Several attempts have been made to use form-locked retaining mechanisms for the shoes to eliminate the effects of the pre-load forces in several sections of the mechanism, between shoe and swashplate, shoe and retainer plate and retainer plate and its joint mechanism consisting generally of a spring-loaded ball.

Prior art designs of form-locked retaining mechanisms surrounding the drive shaft are located at the outer circumference of the mechanism or do not allow the shaft to be extended through the swashplate. They are space consuming, do not provide sufficient stiffness to hold the shoes in their desired position and result in higher bearing losses and costs.

Another attempt has been made to reduce the tilting of the shoe by coupling the shoe to a sliding disk, running on the face of the swashplate. (Riedbammer, U.S. Pat. No. 5,056, 403). The sliding disk subassembly, containing all elements of a form-locked mechanism, is pressed with spring force against the swashplate. This form-locked subassembly mechanism reduces the tilting of the shoe relative to the sliding disk, but increases the number of moving parts, high-pressure sealing areas, sensitivity to contamination, cost and friction and space requirements due to the spring force.

Another major loss occurs during the pressurization and depressurization of the pumped fluid and the gases which are contained in the piston bore and the bore channel. Prior art axial-piston pumps have swashplates rotating about a centrally located axis. This results in piston strokes which are symmetrical about their zero degree swashplate angle position. This produces an increasing unswept piston bore volume with decreasing swashplate angle. Therefore, the compression losses are most critical at smaller swashplate angles and higher pressure rates when the ratio of compressed fluid to pumped fluid is high. This contributes significantly to the inefficiency and low suction capacity of an axial piston pump. Some previous attempts have been made to reduce these compression losses by beginning the suction stroke always at the top dead-center position of the piston. Typically, the solutions for all types of axial-piston pumps have been relatively expensive, space consuming, and heavy (Ifield, U.S. Pat. No. 4,129,063), are mechanically not reliable (Bosch, U.S. Pat. No. 3,733,970), do not allow the reversal of the flow direction or not even a full adjustment between maximal and zero degree adjustment angle.

The present speed ranges are limited because of cavitation, occurring between valve plate and cylinder barrel due to high velocities and unfavorable flow patterns at high speeds. The minimum speed is determined by a decreasing efficiency and an increasing torque fluctuation. In typically prior art pumps of medium size, values above 3500 rpm and below 500 rpm are not considered to be practical. Thus the typical speed range of previous axial-piston pumps swashplate type, medium size is approximately 7 to 1.

The present adjustment range of an axial-piston pump swashplate type is limited because of excessive side forces and deflection of the piston in its most extended position in bottom dead-center. The minimum swashplate angle is determined by a decreasing efficiency. In typical prior art pumps, the maximum swashplate angle is 15 to 20, typically 18, and the minimal angle is approximately 7 to 8. Thus the typical adjustment range is approximately 2.5 to 1.

Several attempts have been made to reduce the extension of the piston from the face of the cylinder barrel in bottom dead center. (Friedrich et al, Germany/BRD OL 1954565; Takai, U.S. Pat. No. 4,776,259). Both provide a circumferential relief at the piston bore end at the side of the swashplate, thus providing a deeper reception of the piston and its joint into the piston bore. The reduction of the effects of the piston side forces is marginal since the relief is circumferential, providing very limited or no additional support for the piston.

The development of noise in pumps or motors results from abrupt changes of forces due to abrupt pressure changes in the piston bore when rotating from one valve plate port to another. Prior art designs have basically attempted to delay the pressure change by providing grooves in circumferential direction as extension of the ports. These grooves are noticeably effective only at certain points of operation, varying because of different swashplate angles, speeds, fluid viscosities and pressure ranges. In addition, the grooves increase the internal leakage and therefore reduce the efficiency.

The size and weight of axial-piston pumps and motors of prior art design are too high to be used economically as transmission component in automotive applications, especially when used as a motor. Presently, typical adjustable axial-piston pumps have a power to weight ratio of approximately 2.5 to 1 (hp/lbs.).

It is therefore desirable to increase the efficiency and the transformation ratio (adjustment and speed range) and to reduce the noise, size, weight and cost of an axial-piston pump by overcoming these and other problems in the prior art.

SUMMARY OF THE INVENTION

An improved swashplate type axial-piston pump has increased efficiency, a greater transformation ratio (adjustment and speed range), is smaller in size and weight, develops less noise and is less costly to make it suitable for a wider range of applications, especially for the use as an automotive transmission.

In a preferred embodiment, the piston assembly includes a spherical joint. Socket and ball of this joint are machined to their final shape before they are meshed together. Thus the need to deform one or both parts during the assembly process is eliminated and high strength material can be utilized. This snap-fit joint results in a larger joint with reduced mechanical contact forces and an improved contact surface for less friction, less leakage and reduced cost.

In a preferred embodiment, the piston joint assembly includes a throttle means for balancing or reducing the mechanical axial forces between shoe and swashplate and within the joint between shoe and piston. The throttle means preferably includes a first conduit means in the piston for transferring hydraulic fluid from the piston bore to a first end of the piston, and a second conduit means in the shoe for transferring the fluid from a first shoe end to the swashplate upper surface. A channel means is also provided at the first piston end and the corresponding first shoe end surface for transferring the hydraulic fluid. The channel means at this piston joint surface may have one of several configurations. It may include one or several concentric grooves in one or both, the piston or shoe end surface which may be connected by a passage. Instead, it may include a helical shaped groove in the surface of either the piston or shoe end surface with a concentric groove at the opposite surface. The channel means results first, in an increased high pressure field at the joint, reducing the mechanical contact force and therefore the moment of the joint friction, and second, a hydrostatic pressure field between shoe and swashplate supplied with varying, continuously or intermittently changing pressure rates (considering a comparable flow of leakage at the contact area) proportionally or nearly proportionally with the varying axial shoe force, thus minimizing the remaining mechanical contact force and the friction between shoe and swashplate and the leakage at all swashplate angles.

Due to reduced side forces at the piston in its most extended position, the preferred embodiment includes piston bores having notches in radial direction near the ends of the bores at the side of the swashplate The notches allow the joint and the neck of the shoe to be received deeper into the piston bore at the top dead-center position. This arrangement reduces the contact forces between the piston and piston bore because of a reduced lever arm between piston joint and the onset of the piston bore in bottom dead-center and no tilting forces at the piston after the joint has entered the piston bore. This arrangement allows a larger swashplate angle. The effect of this arrangement at smaller swashplate angles is even greater when used in combination with the off-center swashplate adjustment means discussed later.

The undesirable pre-load forces of the retaining mechanism of prior art designs are minimized in the present invention by providing a form-locked retainer means which retains the shoe in its desired position against the swashplate upper surface. In a preferred embodiment, the retainer means includes a retainer ring or collar that substantially surrounds the pump shaft, and a retainer plate that engages both the retainer ring and shoe. The provision of an internal retainer ring near the shaft increases the amount of usable space at the outer periphery of the swashplate, especially when utilizing a spherical face at the swashplate, permitting a larger swashplate angle, increased stiffness of the mechanism and reduced frictional losses.

In a preferred embodiment, the retainer plate has a substantially spherical upper surface to match the opposite surface at the retainer ring. Furthermore, if a swashplate with a spherical surface is utilized, all mating spherical faces at the swashplate, the shoes, the retainer and the retainer ring have substantially the same center point. This arrangement allows the retainer plate first, to be rotated about the shaft, following the rotational movement of the shoe, and second, to move normal to the shoe axis or swivel about the center point of the spherical surfaces, following the centerlines of the shoes, resulting in a tilt angle between the centerline of the retainer plate and the cylinder barrel that is larger than the swashplate angle. This retaining means allows a smaller bore for the shoe neck in the retainer plate, resulting in improved guidance for the shoe, an increased swashplate angle due to reduced space requirements of the retainer plate in radial and axial direction and when combined with a smaller pump shaft diameter, sufficient space for an internal retainer ring.

The pump according to the present invention has a high speed capacity because of an increased size of the piston bore channel, tilted inward and in circumferential direction, therefore reducing the flow velocity and the turbulence. This is accomplished by a reduced pitch diameter of the valve plate ports and the corresponding bore channel openings.

The area of the valve plate port containing high pressure and the bore channel openings connected with the port create a pressure field whose centroid is distanced from the centroid of the combined hydraulic forces of the piston bores, or reaction forces of the axial piston forces, connected with the port, therefore creating a tilting moment at the cylinder barrel. This tilting moment is substantially compensated by a counter rotating tilting moment created by the combined radial force at the piston joints acting perpendicular to the plane of the centerlines of the pistons in dead-center positions and its distance to the equivalent force point of the cylinder barrel bearing.

To improve the efficiency and reduce the noise, the valve plate has two compensating ports in fluid connection with each other to transfer part of the decompression volume from the high pressure piston in its top dead-center position to the low pressure piston in its bottom dead-center position. This reduces the compression and decompression losses of the pistons in top and bottom dead-center position, their forces when they do not produce a noticeable amount of torque at the shaft (as motor) or fluid flow (as pump) and reduce the development of noise due to a stepwise decrease or increase of fluid pressure, especially when utilizing an even number of pistons for the cylinder barrel.

The present invention includes an off-center, dual axis adjustment mechanism for the swashplate that tilts around an axis, located near the centerline of the piston in top dead-center position. There is an axis for each tilting or flow direction, represented by swivel mechanism with two joints, connecting the swashplate to adjustment plungers. Due to stops at the swashplate and the plungers, the swashplate rotates, starting in neutral or zero degree position, about the plunger joint of the swivel mechanism and then about its swashplate joint. Thus, the center of the swashplate face, starting at the centerline of the shaft, describing two arcs during a complete tilting movement, remains close to the centerline of the shaft.

This tilting movement results in a piston stroke which begins always at the maximum of the top dead-center position and provides minimized dimensions for the retainer ring and retainer plate.

In addition, the plunger provides support for forces of the swashplate in radial direction of its centerline created through side forces of the piston assemblies acting on a spherical face of the swashplate and support against rotation, resulting from the friction between the shoe and the swashplate. A minimum of three joint links on two axes is provided, holding the resulting piston forces of the high and the low pressure section at or within the frame of their support joint This prevents an undesirable cocking of the swashplate around the plane of the centerlines of the pistons in top and bottom dead-center. Another advantage of this arrangement is, that only one swashplate axis is moving while the other remains in its zero-position, simplifying the control of the swashplate adjustment.

It is another feature and advantage of the invention to reduce the weight, size and cost of an axial-piston pump.

These and other features and advantages of the present invention will be apparent to those skilled in the art from the following detailed description of the preferred embodiments and the drawings in which:

DETAILED DESCRIPTION OF THE PREFERRED EMBODIMENT

Figure 1:
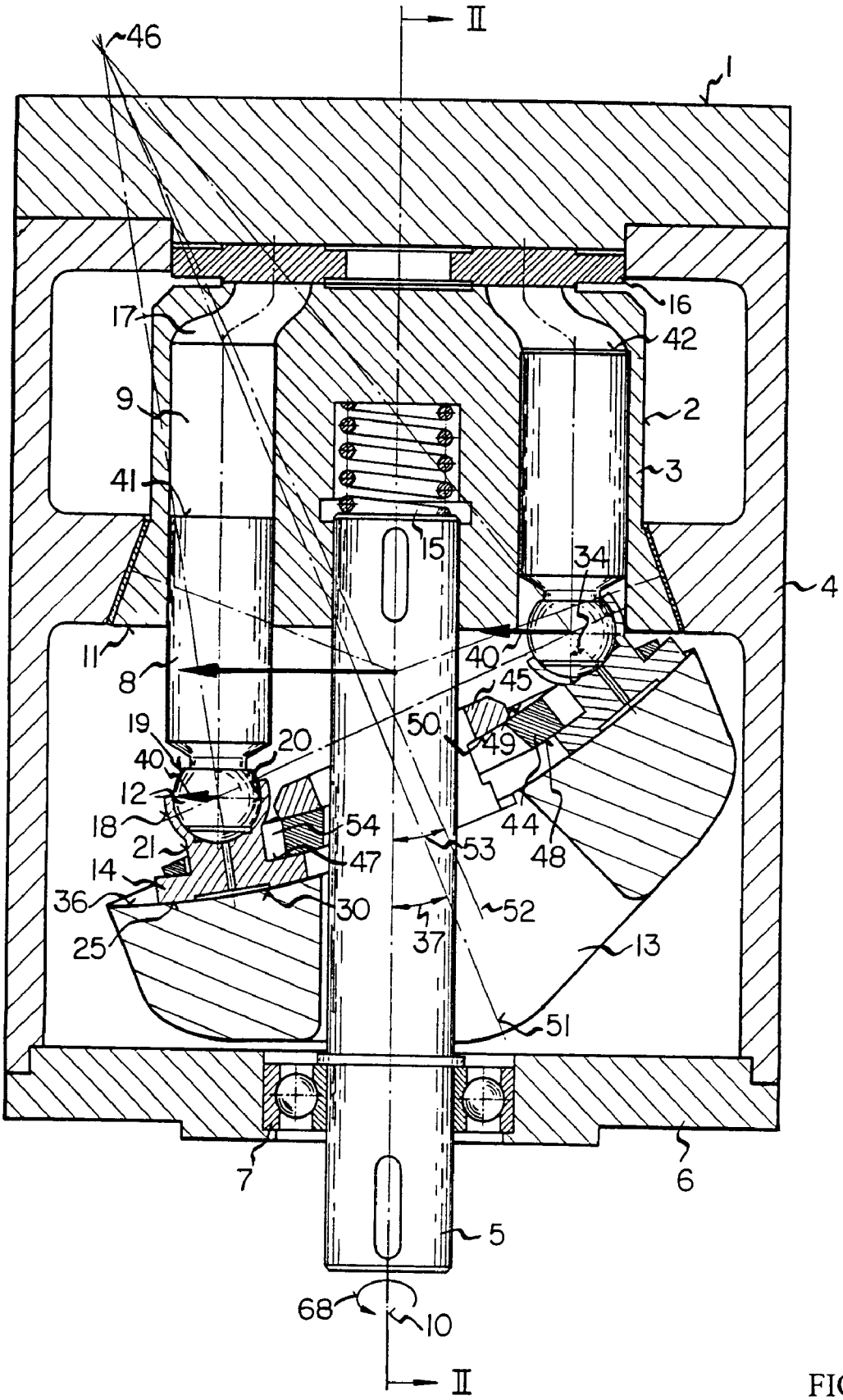
FIG. 1 is an axial sectional view of a swashplate type axial-piston pump, constructed in accordance with the invention, the section being taken along the line I—I, the plane of the piston centerlines perpendicular to the pistons in dead-center position, of FIG. 2.
Figure 2:
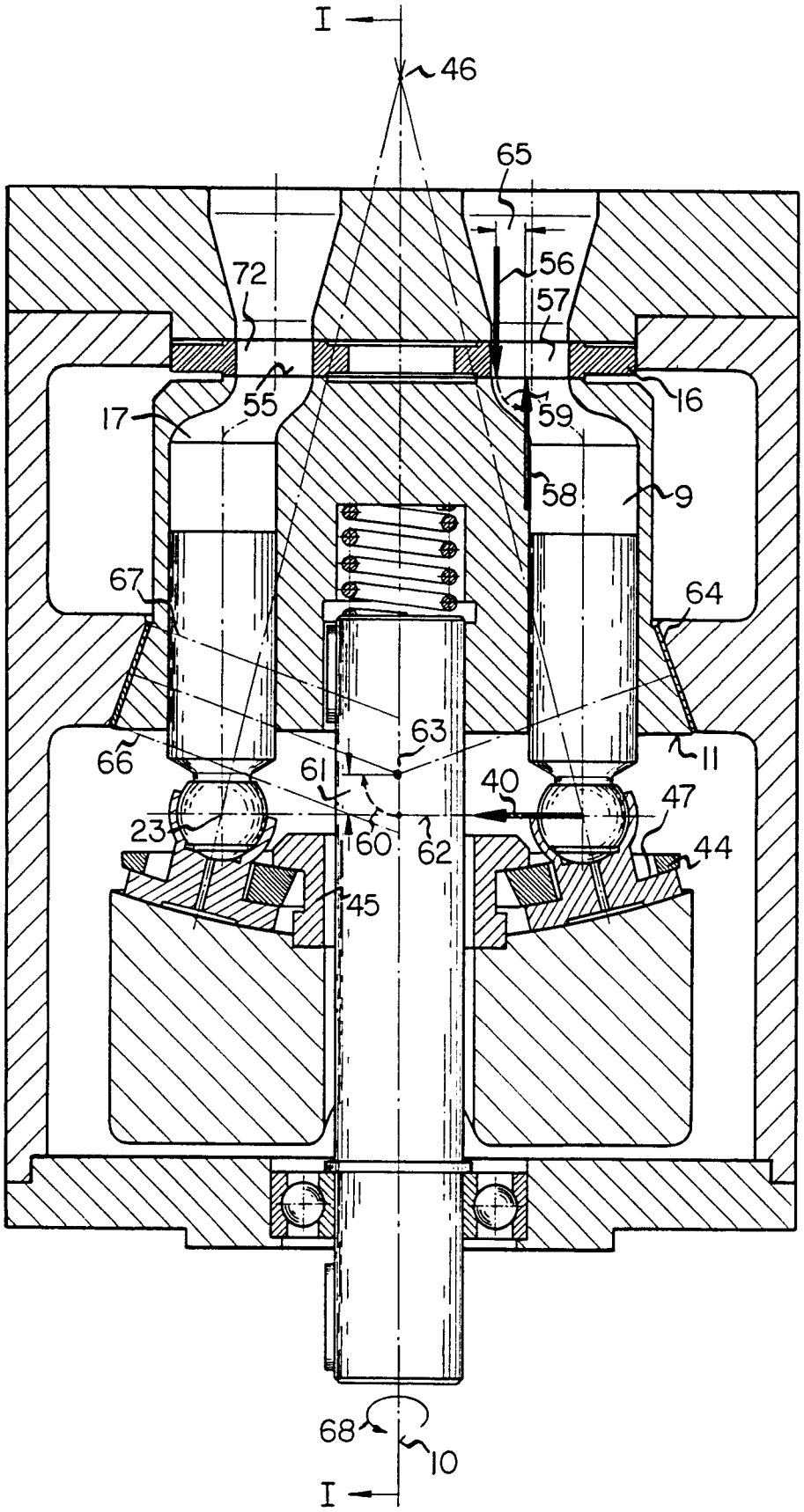
FIG. 2 is the axial sectional view taken along the line II—II, the plane of the centerlines of the pistons in dead-center position, of the axial-piston pump, shown in FIG. 1.

Referring to the figures and in particular to FIGS. 1, 2 a swashplate type axial-piston hydraulic pump 1 embodying various features of the invention is shown. As illustrated, the pump 1 includes a cylinder barrel assembly 2 having a generally cylindrical cylinder barrel 3 rotatably mounted within a pump housing 4. The cylinder barrel 3 of the cylinder barrel assembly 2 is connected to a rotatable drive shaft 5 which extends into the pump housing 4 through an aperture formed in the end cap 6 of the pump housing 4. The drive shaft 5 is journaled for rotation relative to the pump housing 4 by means of a ball bearing assembly and is coupled to the cylinder barrel 3 for co-rotation therewith. Drive shaft 5 can act as either an input or output shaft depending upon whether the machine is used as a hydraulic pump or motor.

The cylinder barrel assembly 2 includes a plurality of individual pistons 8 which are received in respective circular cross-sectioned piston bores 9 formed in cylinder barrel 3. The pistons and bores are disposed around the rotational axis 10 of the drive shaft 5 and cylinder barrel 3 in generally parallel relationship thereto. Each of the pistons is slideably received in its respective piston bore for reciprocating movement along the direction of the cylinder barrel/drive shaft rotational axis 10. Adjacent to the end 11 of the cylinder barrel 3 through which the heads 12 of the pistons 8 extend, the pump is provided with a swashplate 13 having a spherical upper surface 36 facing the cylinder barrel. The swashplate encircles drive shaft 5 and remains generally stationary relative to the pump housing while the drive shaft rotates. The swashplate 13 can be adjustably positioned such, that the plane of its surface is inclined relative to the rotational axis 10 of the drive shaft 5 as illustrated. A plurality of shoes 14 are provided between each piston head 12 and the surface of the swashplate. The shoes of the piston assemblies are mechanically held against the spherical surface of the swashplate, such that they remain in contact with the swashplate as the drive shaft 5 and cylinder barrel 3 rotates within the pump housing. Such rotation results in a shoe following the surface of a swashplate with the effect, that the pistons coupled thereto reciprocate within their respective bores as the cylinder barrel 3 turns.

At its uppermost end, opposite end 11 nearest the swashplate, the cylinder barrel 3 is biased by a spring 15 against a valve plate 16 which, in cooperation with inlet and outlet piston bore channels 17 formed in the cylinder barrel 3, control the flow of hydraulic fluid to and from the piston bores of the cylinder barrel. Thus, as pistons reciprocate in response to rotation of the drive shaft, hydraulic fluid is pumped from the inlet port to the outlet port of the valve plate.

Figure 3:
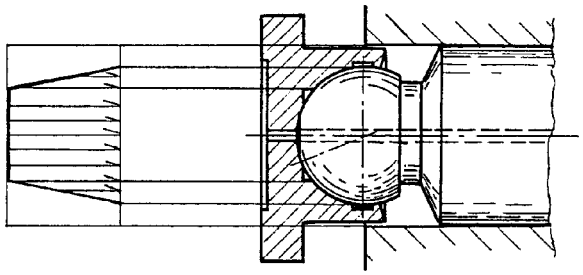
FIG. 3 is an axial side view of the piston joint, partly-balanced execution.
Figure 4A:
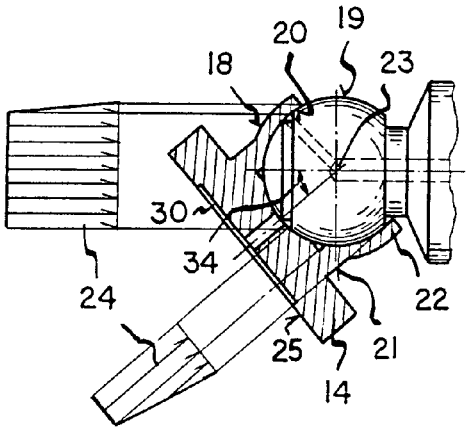
FIG. 4*a* is a piston joint as shown in FIG. 4 in its flexed position.
Figure 4:
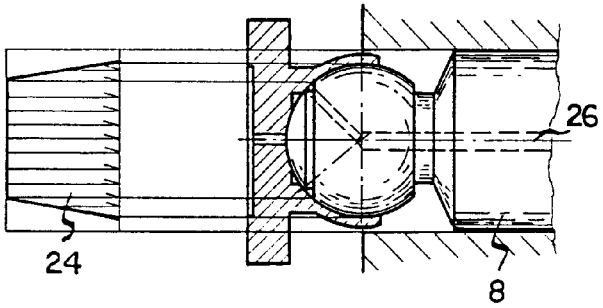
FIG. 4 is an axial side view of a piston joint, snap-fit type with increased partly-balanced hydraulic forces.
Figure 5:
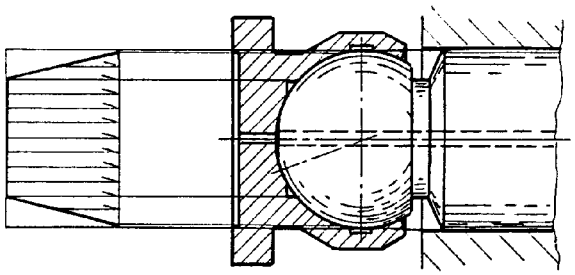
FIG. 5 is an axial side view of a piston joint, nearly fully balanced.

Piston Joint Assembly. In accordance with a principal aspect of the invention, the pump 1 is configured so as to reduce friction in the piston joint 18. To this end, the spherical piston joint means 18 is comprised of a ball 19 and a socket 20 as best seen in FIGS. 1, 4*a*, 6 and 7. The receiving surface of socket 20 is dimensioned so that it approximates the size and shape of the ball 19, in other words, the receiving surface of the socket 20 has a substantially spherical concave shape. Additionally, the diameter of the socket 20 is larger than the diameter of the shoe neck 21. The material used for the socket 20 is preferably steel which is capable of returning substantially to its original shape after the socket has been deformed over the surface of the ball 19. The ball 19 is pressed into the socket 20 under pressure. The outer edges 22 of the socket 20 extend past the geometric center 23 of the ball 19. The encirclement of the shoe has to be reduced noticeably, typically to less than 12° past the geometric center of the shoe, to allow for a permissible elastic deformation of the socket. Accordingly, a 'snap-fit' is achieved when the ball 19 is pressed into the confines of the socket 20. This method of assembly enables the contact surfaces of both, the ball 19 and the socket 20 to be controlled through final assembly. Thus, small uniform clearances may be maintained. Further, deformation or damage to the ball 19 is minimized because no external crimping force is applied to the receiving surface. Enhanced control of the mating surfaces of the ball 19 and the socket 20 result in a bearing area with improved pressure holding capacity of the fluid, thus reducing frictional losses in the piston joint 18. The use of a 'snap-fit' joint between the piston 8 and shoe 14 also enables the dimension of the ball 19, and correspondingly the socket 20, to be increased noticeably over the dimensions of present piston joint assemblies, especially when using steel or the like, as shown in FIG. 3 while still allowing the joint to be received into the piston bore. The resulting larger contact area and the even more increased sealing area due to a mating surface of the socket 20 which extends beyond the geometric center 23 of the ball 19, allow a larger high pressure field 24 which reduces the mechanical contact force of the piston joint 18 as shown in FIGS. 4 and 4*a*. Finally, the tilting moment of the shoe 14 with respect to the swashplate 13 is decreased significantly because the moment of friction 43 (FIG. 6*a*) at the joint increases linearly with the radius of the ball 19 while the pressure field 24 increases with the square of the ball radius.

Figure 6:
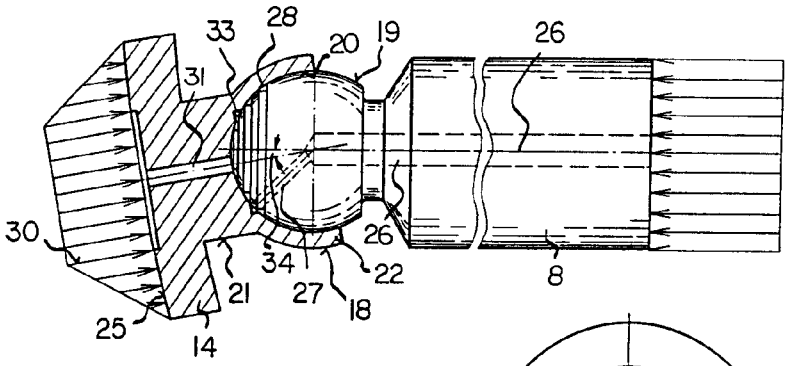
FIG. 6 is an axial side view of a piston joint, snap-fit type with a plurality of concentric grooves.
Figure 6D:
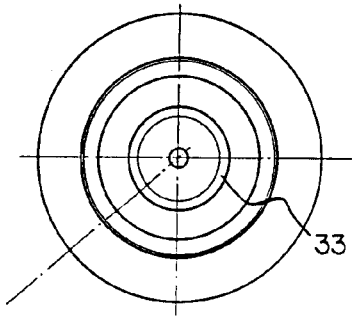
FIG. 6*d* is a top elevation view of the joint socket in FIG. 6*a*.
Figure 6A:
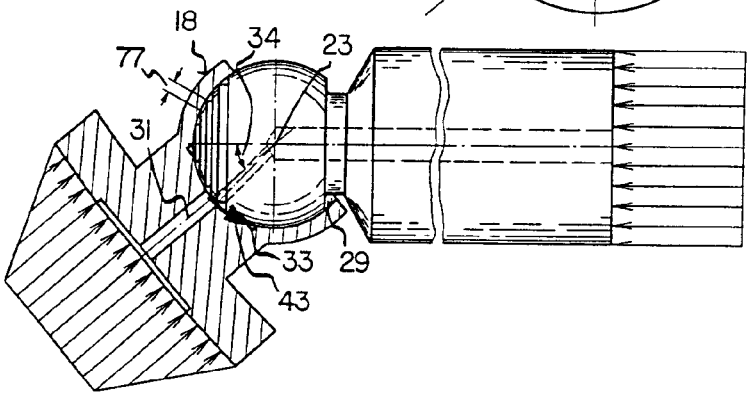
FIG. 6*a* is a piston joint as shown in FIG. 6 in its fully flexed position.
Figure 6C:
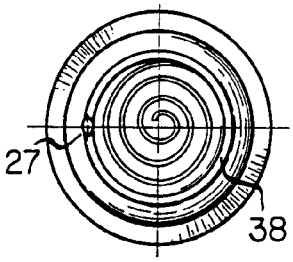
FIG. 6*c* is a top elevation view of a ball joint as shown in FIG. 6 with an alternative embodiment.
Figure 6B:
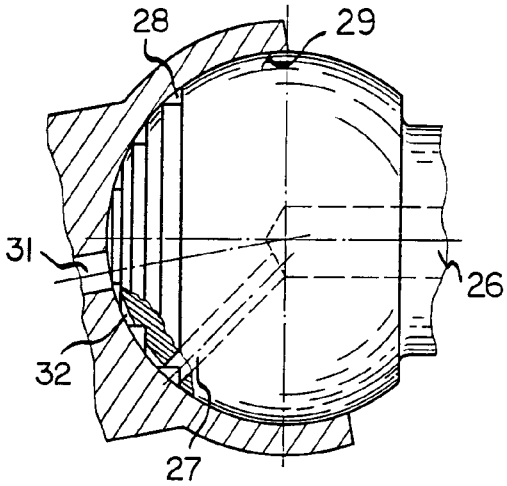
FIG. 6*b* is an enlarged section of the piston joint with a separate passage (throttle).

Piston Joint Throttle System. In accordance with still another principal aspect of the invention, the pump 1 is configured to reduce the friction at the piston joint 18, and the leakage and friction at the face 25 of the shoe 14 as best shown in FIGS. 4, 6, 6*b* and 7. Each piston 8 is provided with a bore 26 extending longitudinally through the piston. A passage 27 is machined to provide the groove arrangement 28 at the surface of the ball 19 with pressurized fluid. As best shown in FIGS. 6, 6*b*, the groove arrangement 28 consists of a plurality of grooves, spaced generally parallel to each other. The surface 29 of socket 20, opposite to the spherical surface of the ball 19, is connected with the recessed pressure field 30 at the shoe face 25 through bore 31. Thus the internal fluid conduit means bore 26, passage 27, groove arrangement 28 including groove 33 or passages 32 or 35 and bore 31 provide fluid communication between piston bore 9 and the high pressure field 24 between shoe and swashplate to balance or nearly balance the hydraulic forces of piston 8 and shoe 14 in axial direction. The passage or throttle 32 (FIG. 6*b*) at the ball surface or groove 33 (FIGS. 6*a*, 6*d*) at the surface of the socket 20 provide the groove arrangement 28 at the ball surface with pressurized fluid. This fluid travels through bore 26 and passage 27 to the grooves 28 at the ball surface. The fluid can travel directly through bore 31 to the recessed pressure field 30 at the face 25 of shoe 14 if the shoe is aligned with passage 27 of the ball (FIG. 6*a*). If passage 27 or its grooves 28 on the ball surface and the bore 31 are not directly aligned, the pressurized fluid has to travel through passage 32 or groove 33 to provide the pressure field 30 at the shoe face 25 with pressurized fluid. This means, the smaller the angle of flexion 34 between piston and shoe, and therefore a smaller mechanical axial force of the shoe, the larger the throttle effect will be for the fluid, traveling from piston chamber 9 to pressure field 30 of shoe face 25. The larger throttle effect, being a result of a longer passage and/or a smaller cross section of the grooves, reduces the pressure of pressure field 30 and therefore its hydraulic force, assuming a constant flow of leakage between the face 25 of shoe 14 and face 36 of swashplate 13. The reduced hydraulic force at smaller angles of flexion result into nearly constant mechanical contact force between both faces, acting at the outer circumference of the face of the slightly tilted shoe 14. This force times the shoe face radius overcomes the moment of friction 43 of the piston joint and reduces the amount of tilting and therefore the leakage. Less leakage reduces the pressure drop between piston chamber and shoe face and increases therefore the hydraulic force of pressure field 30. The continuously changing angle of flexion of the piston joint with its shoe acting on a spherical surface of a tilted swashplate, results in a fluctuating axial shoe force and a counter force consisting here of an equally fluctuating hydraulic force of pressure field 30 and a basically constant mechanical contact force between shoe and swashplate overcoming the moment of friction at the joint. This arrangement reduces energy losses and wear due to the minimization of leakage and of reduced constant mechanical forces between shoe 14 and swashplate 13, especially at larger swashplate angles.

The distance 77 (FIG. 6*a*) between the plurality of grooves 28 can vary from being noticeably shorter or wider than the diameter of bore 31 in the shoe or a comparable recessed portion at the surface 29 of the socket 20 (FIG. 6*b*). Depending on the distance 77 between the grooves, an intermittent flow or a varying throttle effect can be achieved. This arrangement is preferably used in conjunction with the spherical face 36 at the swashplate 13 where the angle of flexion 34 between the shoe 14 and piston 8 changes continuously during each revolution, independent from the swashplate angle 37 (FIG. 1). Alternately, a helical groove 38 can be used to carry the fluid from passage 27 to bore 31 to provide a variable, intermittent flow or throttle effect to the recessed pressure field 30 at the shoe face 25 (FIG. 6*c*).

Figure 7A:
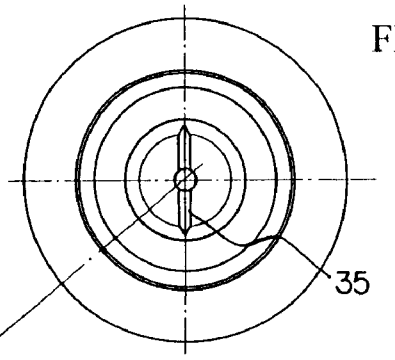
FIG. 7*a* is a top elevation view of a joint socket as shown in FIG. 7.
Figure 7:
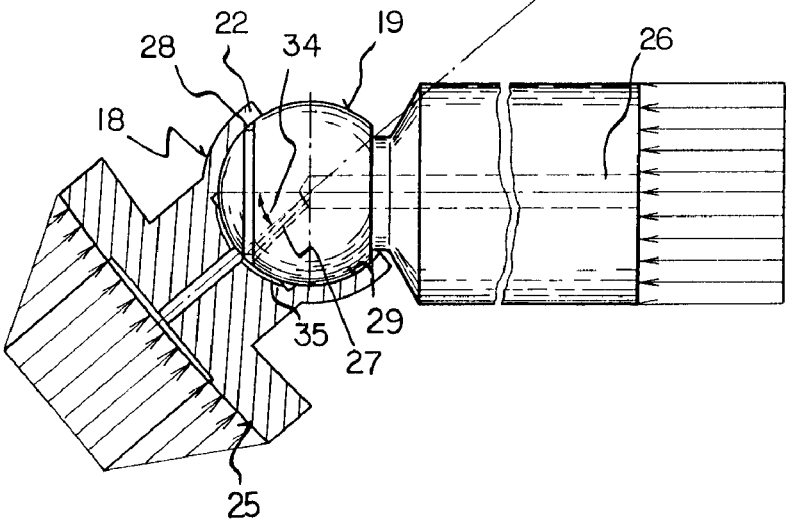
FIG. 7 is an axial side view of a piston joint, snap-fit type with an alternative embodiment.

FIG. 7 shows an alternative embodiment in which the groove arrangement 28 at ball 19 consist of one groove. The passage or throttle 35 at socket surface 29 connects the groove 28 with bore 31 and the recessed pressure field 30 at the shoe 14. A reduced angle of flexion 34 reduces the flow of fluid to the pressure field 30 due to the increased throttle effect of passage 35.

The groove or grooves 28 provide a larger pressure field at the joint 18 of the piston 8 than previous designs, thus reducing the mechanical contact force between shoe 14 and piston 8 by increasing the hydraulic force of pressure field 24, as best shown in FIG. 4.

The movement between the joint surfaces of ball 19 and socket 20 and their grooves 28, 33 and 38 and passages 32 and 35 removes dirt or other contaminants which could block fluid flow through the grooves and passages. This greatly increases the reliability of the joint throttle mechanism.

Figure 8:
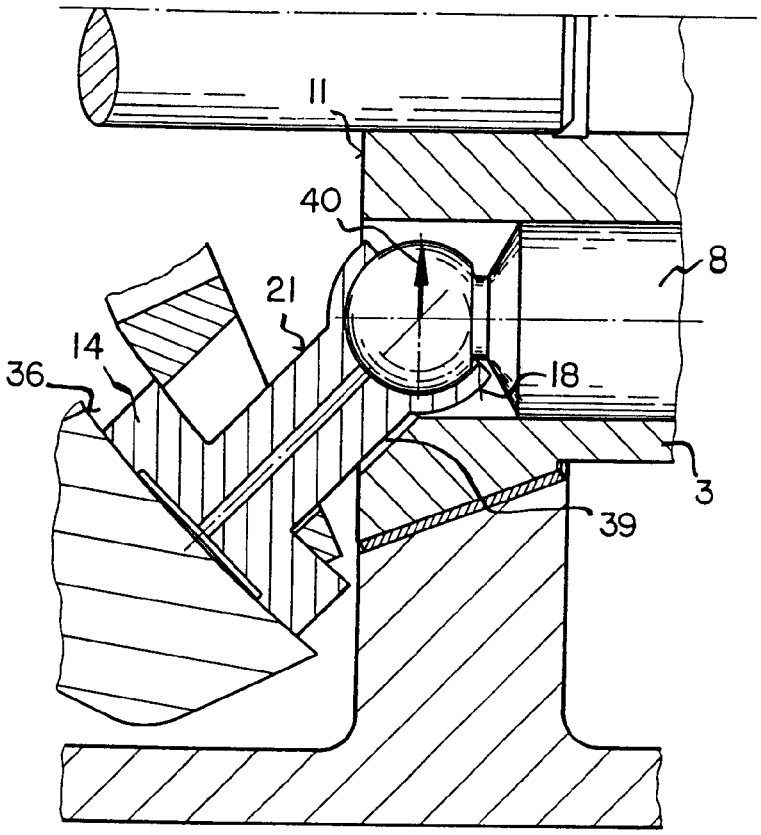
FIG. 8 is a partial, sectional side view of the cylinder bore with a relief notch.
Figure 8A:
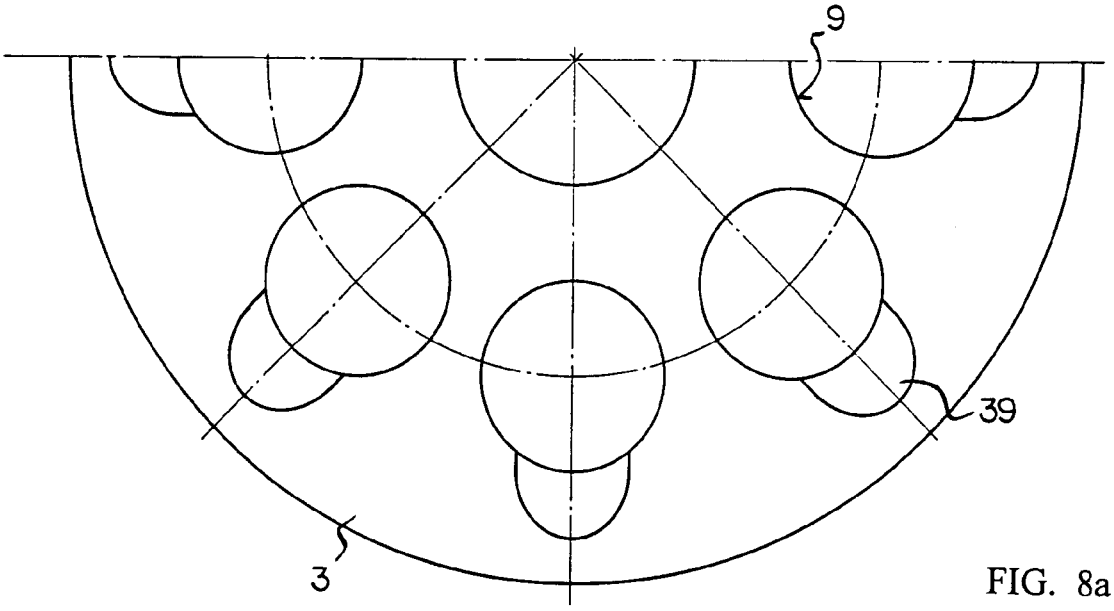
FIG. 8*a* is a top view of the cylinder barrel with bore relief notches as shown in FIG. 8.

Piston Side Forces. In accordance with another principal aspect of this invention, the piston bores 9 are provided with notches 39. As best seen in FIGS. 8 and 8*a*, the notches provide clearance, allowing the neck 21 of shoe 14 to be received more fully into the piston bore 9. This enables the significantly increased piston side forces 40, at or near at top dead-center position, resulting from the utilization of a sperical swashplate face 36 to be more effectively controlled. This improved control results from a reduced lever arm between the piston joint 18 and the end 11 of the cylinder barrel 3. Because the piston 8 is no longer subjected to high piston side forces in an extended position (bottom dead-center 41), tilting forces and therefore wear and friction are significantly reduced. (FIG. 1) This arrangement also enables a large portion of the piston joint 18 to remain fully received within the piston bore 9 at small swashplate angles 37, especially when using an off-center adjustment mechanism for the swashplate as discussed later. Because torque produced by the pump/motor is lowest at small swashplate angles 37, this invention reduces the deleterious effects of side forces to a minimum when efficiency is most critical.

Retaining Mechanism. As best seen in FIGS. 1 and 2, the pump 1, in accordance with another principal aspect of the invention, includes a novel retaining mechanism, consisting of retainer plate 44 and retainer ring 45, for insuring proper orientation of the shoe 14 on the concave spherical swashplate upper surface 36. In the preferred embodiment, the center of the curvature 46 of the spherical upper surface 36, the spherical shoe face 25, shoe upper face 47, retainer plate lower surface 48 and upper surface 49 and the lower spherical face 50 of retainer ring 45 are identical or nearly identical. This arrangement yields two degrees of freedom for the retainer plate 44. The first degree of freedom allows rotation around the drive shaft 5 in a position which is perpendicular or tilted with respect to the shaft, respectively around the centerline 51 of swashplate 13, to follow the rotational movement of the shoes 14 around rotational axis 10 of cylinder barrel 3. The second degree of freedom allows a swivel movement of the retainer plate around the center of the curvature 46 in radial or nearly radial direction to the centerline 52, of the retainer plate to follow, respectively, to remain normal to the centerline of the shoes and centered to the centerline 52 of the retainer plate which corresponds to the geometric centers 23 of the piston joints 18. The shoes 14 drive the motion of the retainer plate 44. This results in a tilt angle 53 between centerline 52 of retainer plate 44 and rotational axis 10 and cylinder barrel 3 which is larger than the swashplate angle 37. This excentric location of retainer plate 44 relatively to swashplate 13 minimizes its dimension in radial direction regarding its inner and outer diameter, as well as the diameter of its bores 54, thus resulting in maximum coverage of the shoe upper face 47.

These reduced dimensions enable the swashplate angle 37 to be increased. Furthermore, additional space is now available for an internally form-locked retainer ring 45 (FIGS. 1, 2). Because of the spherical shape of the contact area between retainer plate 44 and retainer ring 45, no additional space in axial direction is needed for the retaining mechanism. This arrangement provides strong retention due to high stiffness and reduced friction losses, furthermore, improve space conditions are provided for an off-center adjustment mechanism as discussed later. The reduced dimensions are especially effective when utilized in conjunction with the small shaft diameter which is made possible by the invention in U.S. Pat. No. 4,615,257, the specification of which is incorporated herein by reference.

Increased Speed Range. In further accordance with one aspect of the invention, the bore channel 17 curves inward from the piston bore 9 to the cylinder end 55 at the side of the valve plate 16, as best shown in FIGS. 1, 2. The location of the centroid of the pressure field, creating the hydraulic force 56 at the port 57 of the valve plate 16, determined by the degree of inward tilt of the bore channels 17 and the combined hydraulic force 58 of the piston bores 9 ($C_{G1}$, $C_{G2}$ in FIGS. 11*a*, 11*d*), connected with port 57, create a cylinder-tilt-moment 59, in counterclockwise direction in the plane of the piston centerlines perpendicular to the pistons in dead-center position which is opposed by the counter rotating cylinder-tilt-moment 60 in clockwise direction, resulting from the radial side forces 40 at the piston joints 18, acting on lever arm 61 at the centerline 10 of the cylinder barrel between the plane 62 of the piston joints 18 and the equivalent force point 63 of the cylinder barrel bearing 64, as shown in FIG. 2.

The distance 65 between the forces of the valve plate, created by the inward tilt, is preferably selected and controlled so, that the tilting moments 59 and 60 nearly balance each other. This improves the operation by reducing cocking and tilting tendencies of the cylinder barrel 3, thus reducing wear and leakage. It should be noted, that the lever arm 61 and therefore the tilting moment 60 will decrease with a reduced swashplate angle 37 when using an off-center swashplate adjustment as discussed later. This would require a smaller moment 59 at the port 57 to balance the tilting moment 60 at cylinder barrel 3. At reduced swashplate angles 37, the piston side forces 40 move from a position near the lower projection line 66 to a position near the upper projection line 67 as shown in FIG. 2. This reduced tilting moment 60 causes an unbalance of tilting moments at the cylinder barrel. It should be noted, that the tilting moments, created through the piston side forces, perpendicular to the plane of the centerlines of the pistons in their dead-center positions (FIG. 2) and perpendicular to those (FIG. 1) which produces the torque 68 at shaft 5 have a resulting tilting moment which moves in a closer range within the lower 66 and upper projection line 67 of the cylinder barrel bearing 64. This bearing 64 is located and designed to bear the forces without damage.

Figure 9A:
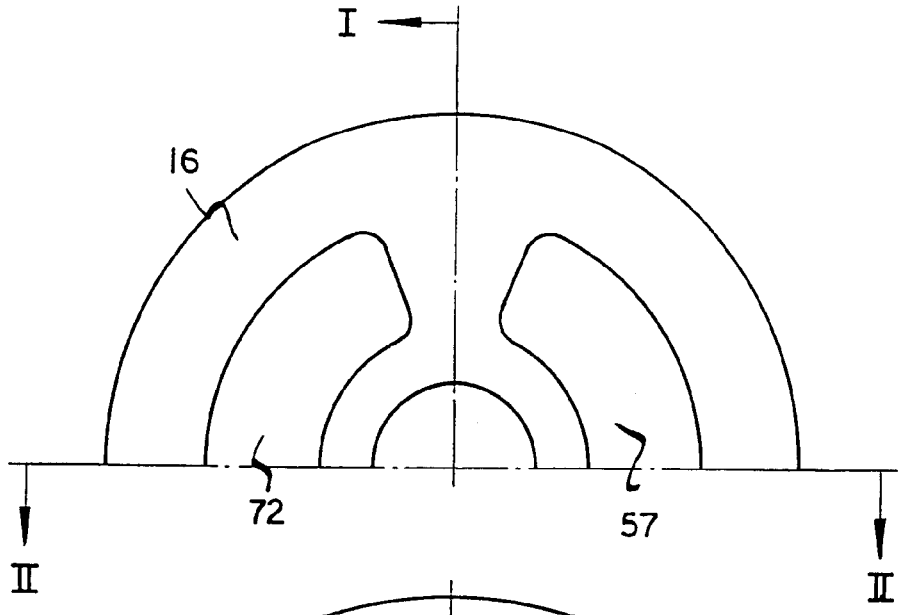
FIG. 9*a* is a top view of the valve plate for the cylinder barrel as shown in FIG. 9.
Figure 9:
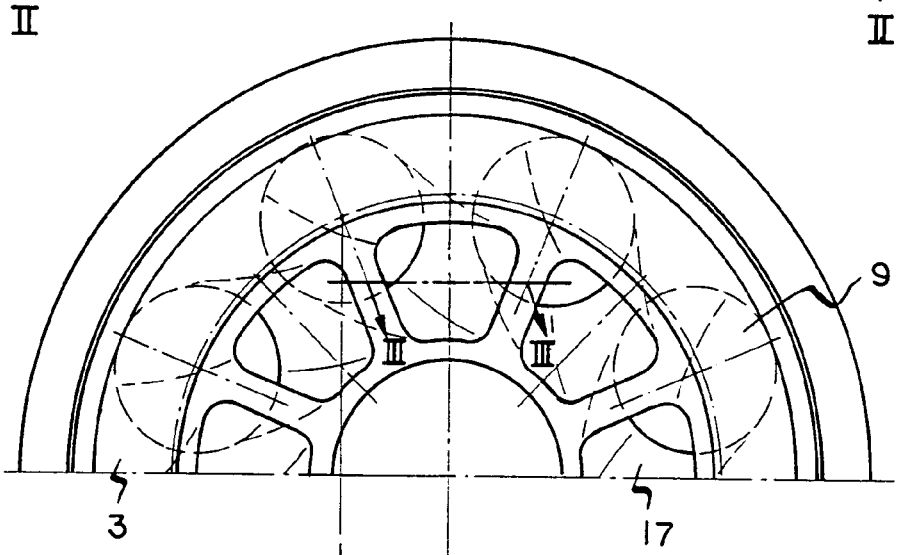
FIG. 9 is a top view of the cylinder barrel from the valve plate side, showing the bore channel arrangement and bore channel openings.
Figure 9B:
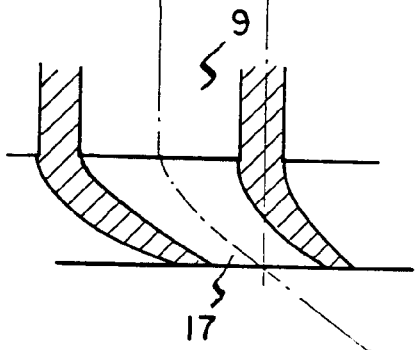
FIG. 9*b* is an axial cross-sectional view of the piston bore channel being taken along line III—III of the cylinder barrel as shown in FIG. 9.
Figure 9C:
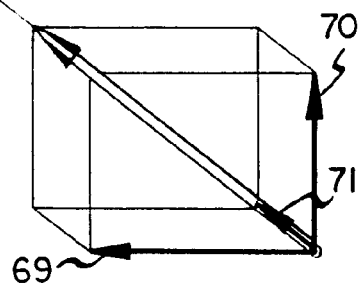
FIG. 9*c* is a velocity diagram, depicting the resulting velocity and its components of the bore channel as shown in FIG. 9*b*.

Further, as shown in FIGS. 9 to 9*c*, the inward tilt of the bore channel 17 and the reduced diameter of the ports 57 and 72 at valve plate 16 increases the open area of the bore channel 17 and the ports at the valve plate, representing the same valve port area on a smaller pitch diameter, thereby reducing the circumferential 69 and axial velocities 70 to which the fluid is exposed. In addition, the inward tilt of channel 17 allows centrifugal forces to assist the hydraulic fluid flow to the cylinder bore in radial direction 71 during the critical suction stroke. The inward tilt of the bore channels 17 in circumferential direction (FIG. 9*b*) allows a shock-free entrance of fluid into the first section of bore channel 17, thus reducing the likelihood of cavitation by providing less turbulent flow, when the first section of bore channel 17 closest to the valve plate is substantially parallel to the resulting flow velocity vector of the axial, radial and circumferential flow velocity vectors. The reduced velocities, centrifugal forces and less turbulent fluid flow result in significantly higher revolution per minute where cavitation occurs. The resulting wider speed range increases the range of applications and the reduced tendency for cavitation extends the useful life of the fluid and the pump or motor.

Figure 10:
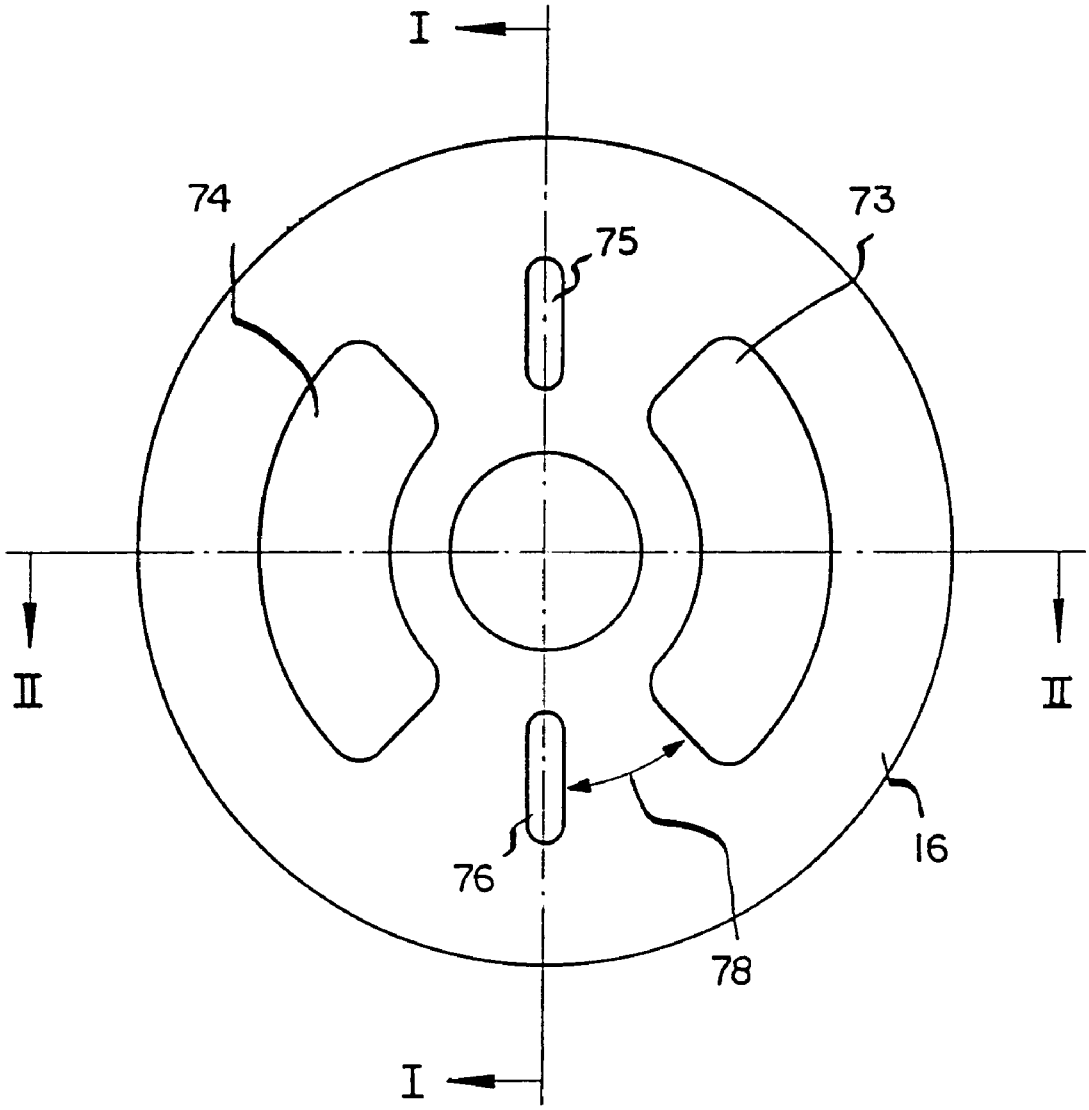
FIG. 10 is a top view of a valve plate with compensating ports.

Compensating Ports. In accordance with another principle aspect of the invention, the two main ports 57 and 72 of valve plate 16 (FIG. 2), are divided into two smaller ports 73 and 74 and two compensating ports 75 and 76 (FIG. 10), located at or near the dead-center positions 41 and 42 (FIG. 1), of the piston bores 9. The compensating ports 75 and 76 are in fluid connection with each other. The paths 78 between the main ports 73, 74 and compensating ports 75 and 76, reflect in circumferential direction the shape of the bore channels 17 and have the same or nearly the same width (FIG. 10). During rotation, the piston bores 9 near the deadcenter position 41 and 42 will be connected with the compensating ports 75 and 76. The decompression of the high pressure piston bore results in a pressure increase in the compensating port 76, including the low pressure compensating port 75 and the piston bore connected to it. After further rotation, the pressure in the piston bores 9 will adapt to their final pressure level when entering the main ports 73 and 74. This stepwise pressure adaptation results in a medium pressure for the pistons in their dead-center position 41 and 42 and reduces the compression/decompression losses due to an exchange of compressed oil during the transition from one pressure port to the other, and the losses in friction and leakage at the pistons in these positions due to lower pressure and forces. The reduction in losses is noticeably larger than the reduction in power since the pistons in or near their dead-center positions do not participate proportionally to their forces on the development of torque of the pump/motor due to their short lever arm.

Figure 11:
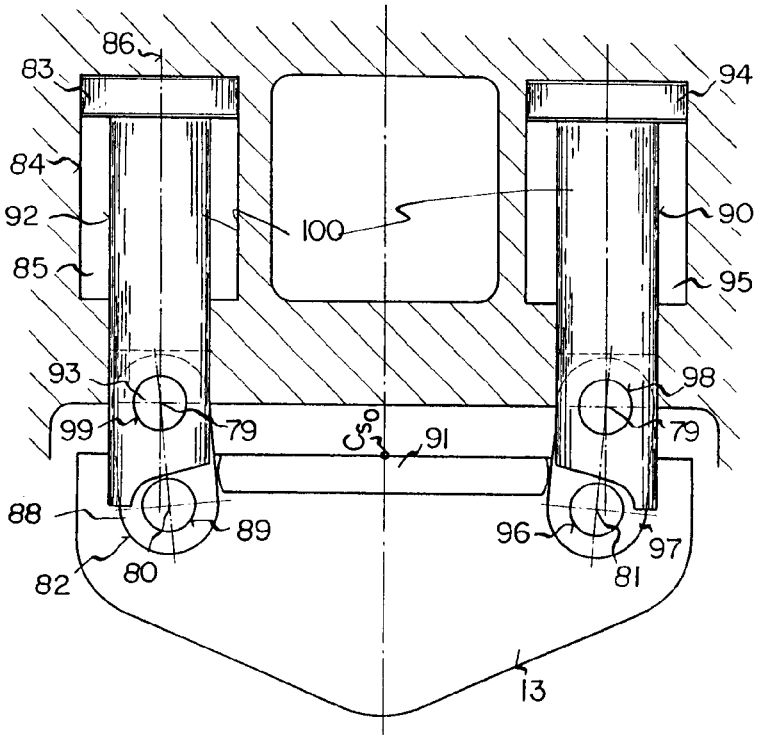
FIG. 11 is a side view of an off-center adjustment mechanism with two axes in its non-tilted position.
Figure 11A:
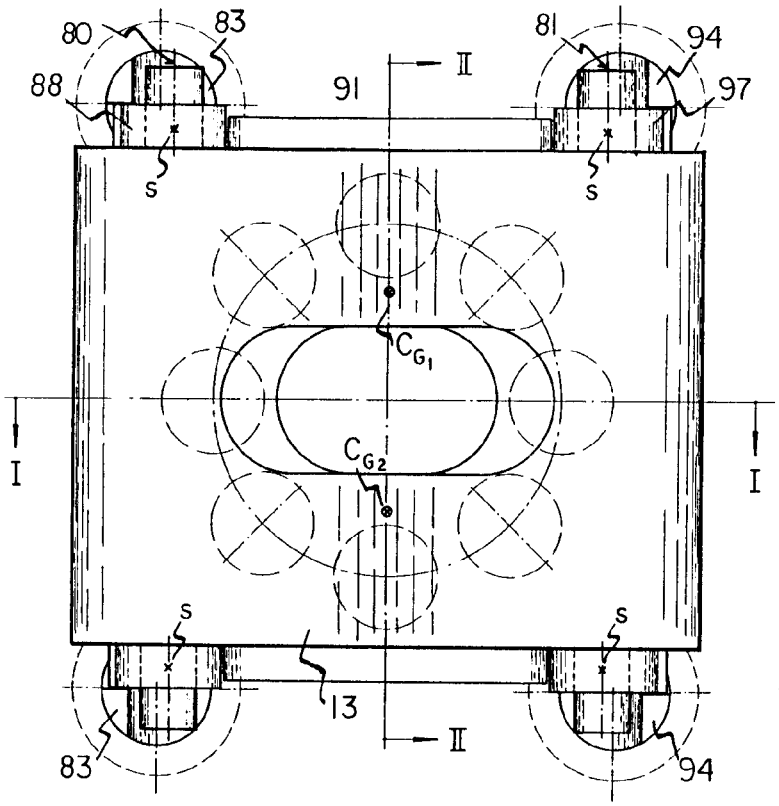
FIG. 11*a* is a top elevation view of the off-center adjustment mechanism as shown if FIG. 11.

Off-Center Adjustment. In further accordance with one aspect of the invention, an off-center, dual axis adjustment mechanism 100 for moving the swashplate 13 about two dual axis of rotation 79–80, 79–81 is provided. Referring to FIG. 11, the dual axis adjustment mechanism 100 includes a swivel mechanism 82, shown in its untilted position. This mechanism further includes an upper plunger 83 that is received in an upper adjustment cylinder 84. The upper interior chamber 85 can be alternately pressurized and depressurized to move the upper plunger 83 along a generally horizontal upper adjustment cylinder axis 86. The pressure in upper interior chamber 85 balances the forces which are applied to the swashplate by the pistons 8. Alternately, upper exterior chamber 87 (FIG. 11*b*) may be alternately pressurized and depressurized with upper interior chamber 85 to move upper plunger 83.

A rod 93 is connected to upper plunger 83. A link 88 is rotatably connected to rod 93, acting as upper plunger joint 99. The link 88 is attached to the swashplate 13 by a swashplate joint 89. The off-center, dual axis adjustment mechanism 100 may also include lower plunger assembly 90 that is attached to the opposite end of swashplate 13 and functions identically, although in reverse direction as the swivel mechanism 82 as described before. A stop 91 extends from the swashplate to a position between and adjacent to the upper plunger assembly 92 and the lower plunger assembly 90.

Figure 11B:
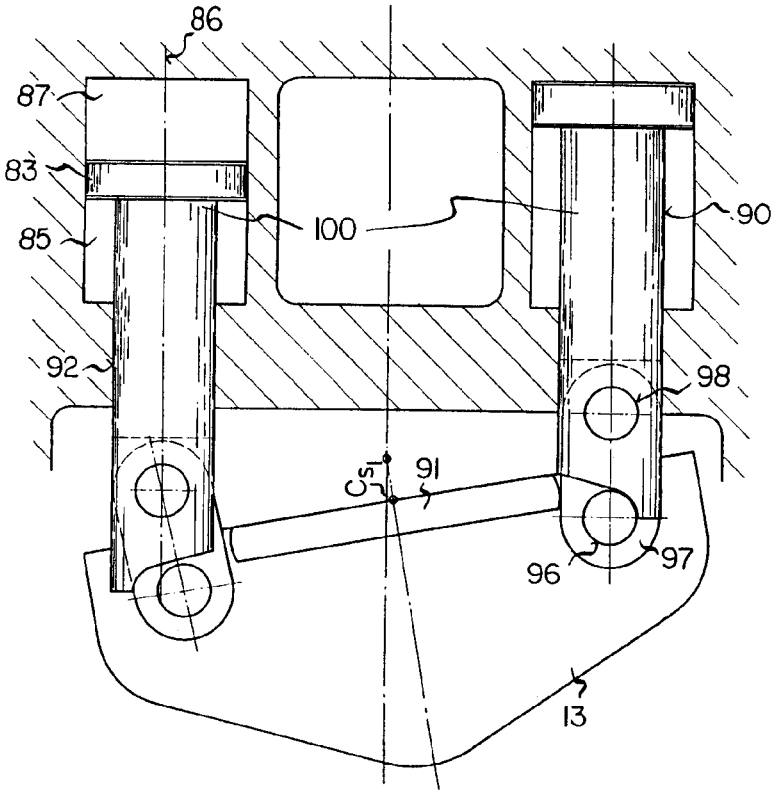
FIG. 11*b* is a side view of an off-center adjustment mechanism as shown in FIG. 11, at the end of the first section of the tilting movement.

In response to the forces applied to the swashplate 13 by the pistons 8, upper plunger 83 moves through the upper interior chamber 85 along the upper adjustment cylinder axis 86. The plunger rod 93 moves coordinately with the upper plunger 83, while the lower plunger 94 is held in its zero position by hydrostatic pressure in the lower interior chamber 95. Accordingly, movement of the upper plunger assembly 92 causes rotation about the dual axis of lower plunger assembly 90, as shown in FIGS. 11, 11*b* and 11*c*.

Starting at maximum tilting angle (FIG. 11*c*), rotation of the upper plunger assembly 92 occurs first around the lower swashplate joint 96. This rotation is limited by the clearance between the stop 91 at swashplate 13 and the link 97 of the lower plunger assembly 90. Accordingly, rotation about the lower swashplate joint 96 soon ceases due to binding contact between the stop 91 and the lower link 97 (FIG. 11*b*). As the upper plunger 83 continues to travel through the upper exterior chamber 87 back to its zero position, rotation of the upper plunger assembly 92 occurs around the lower plunger joint 98. Lower plunger assembly 90 can perform the same function as upper plunger assembly 92 in the reverse direction. By this arrangement, the swashplate 13 is rotated along the two dual axis of rotation 79/80 and 79/81. A minimum of 3 swivel mechanism 82 on two axis of rotation 79/80, 79/81 at the swashplate are arranged that the centroids of the piston forces $C_{G1}$, $C_{G2}$ and their shoe forces are located at, near or within the connecting lines at the joint forces S, as best shown in FIG. 11*d*.

The off-center, dual axis adjustment mechanism 100 provides numerous advantages. First, the dual axis rotation provided by this arrangement yields a stroke of piston 8 which starts always at top dead-center (42) as shown in FIG. 1. This minimizes the volume of the piston bore 9 which is unswept by the piston 8. In other words, the only unswept volume is the space in the bore channel 17 between piston bore 9 and the valve plate 16. This reduces compression losses at smaller swashplate angles and improves the suction capability of the pump. Second, the off-center, dual axis mechanism moves the plane of the piston joints 62 as shown in FIG. 2 closer to the end 11 of cylinder barrel 3 with declining swashplate angles. This reduces the piston side loads at the piston bores 9 at smaller swashplate angles, thereby reducing frictional losses and the leakage between piston and bore due to an increased sealing length.

Figure 11C:
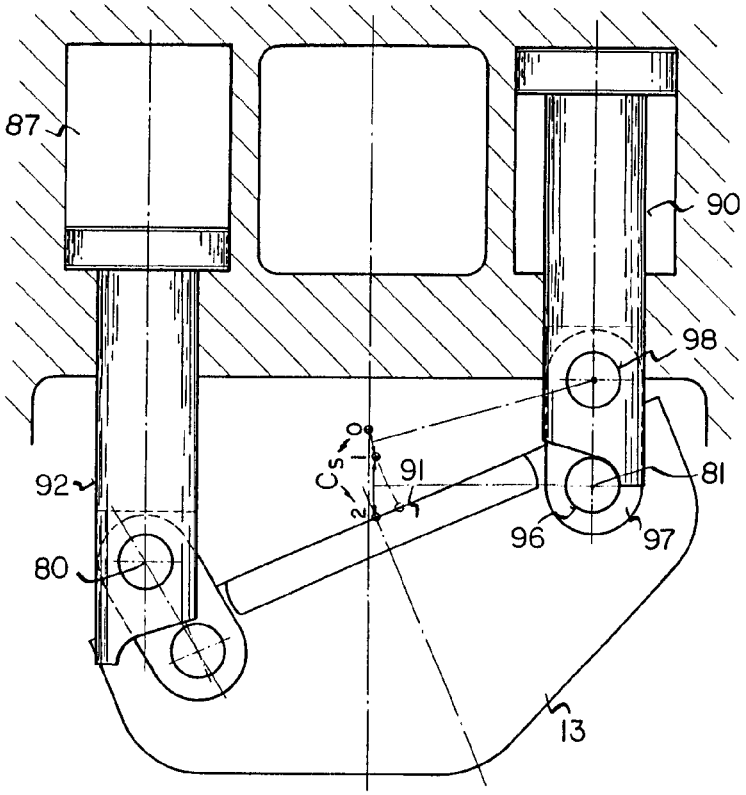
FIG. 11*c* is a side view of an off-center adjustment mechanism as shown in FIG. 11 at the end of the second section of the tilting movement, its fully tilted position.
Figure 11D:
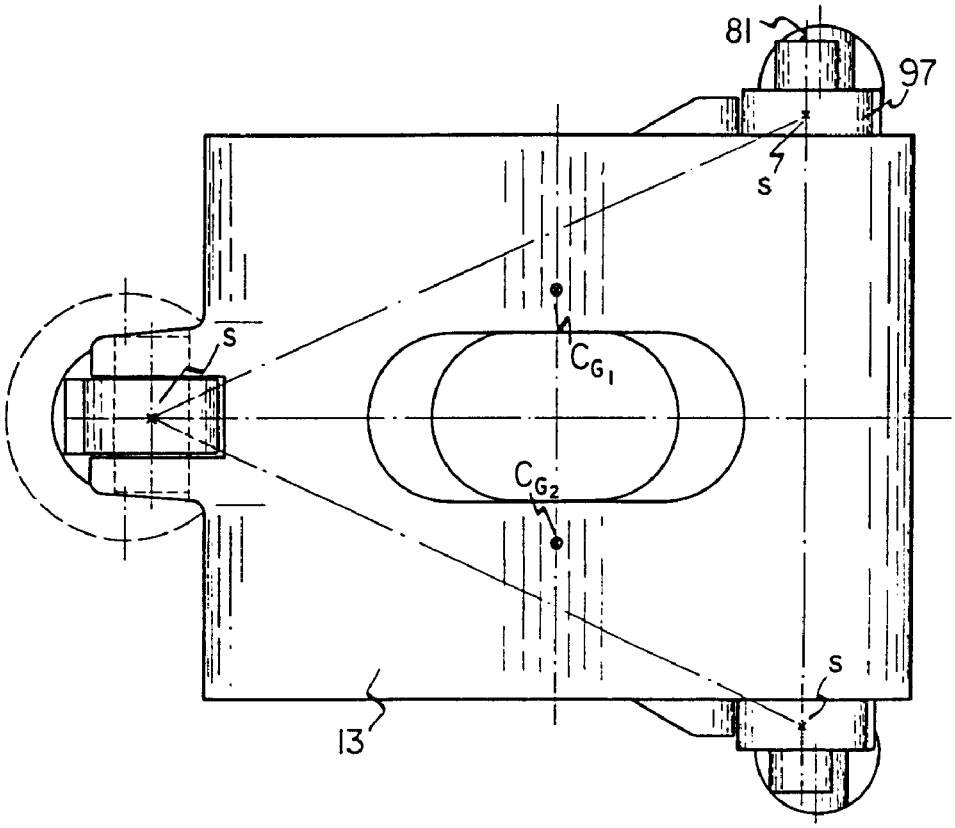
FIG. 11*d* is a top elevation view of an off-center adjustment mechanism with a minimum number of three joint links.

In addition, the off-center, dual axis mechanism, and here especially in connection with the swivel mechanism 82 reduces the offset of center $C_{S(0,\ 1,\ 2)}$ of the spherical upper surface of swashplate 13 from the rotational axis 10 of shaft 5 as best shown in FIGS. 11 and 11*c*. This reduced deviation of the center $C_{S(0,\ 1,\ 2)}$ results in improved space conditions for a greater swashplate angle 37 and more space for related mechanism, i.e., retainer plate 44, retainer ring 45 and shaft 5.

The present innovation thus results in a swashplate type axial-piston pump with significantly increased efficiency (i.e., less leakage, friction, compression volume), transformation range (i.e., adjustment angle and speed) and significant reductions in size, weight, noise and cost.

While several particular embodiments of the invention have been shown and described, it will be obvious to one skilled in the art, that changes and modifications may be made without department from the invention in its broader aspects. Therefore, the aim in the appended claims is to cover all such changes and modifications as fall within the true spirit and scope of the present invention.

I claim:

1. An axial-piston pump comprising:

a rotatable shaft;

a rotatable cylinder barrel assembly, having a cylinder barrel and a piston assembly received in a piston bore of said cylinder barrel;

a swashplate, having an inclined upper surface for engaging said piston assembly;

said piston assembly, comprising a piston, connected to a shoe by a substantially spherical joint means;

said substantially spherical joint means comprising a substantially spherical ball and a concave substantially spherical socket;

said ball and said spherical socket being dimensioned such that the internal dimensions of said spherical socket approximate the size and shape of said ball;

said spherical socket comprising a material which allows for elastic deformation of the socket so that the socket is capable of substantially returning to its original shape after being slightly deformed;

said spherical socket being formed to its final shape before being joined with said ball;

said spherical socket encircles more than one half of said ball, but not more than 205 degrees.

2. An axial-piston pump comprising:

a rotatable shaft;

a rotatable cylinder barrel assembly having a cylinder barrel and at least one piston assembly including a piston received in a piston bore of said cylinder barrel;

a swashplate having an inclined upper surface for engaging said piston assembly;

a substantially spherical joint connecting said piston to a shoe of said piston assembly;

said substantially spherical joint including a ball having a surface and a substantially concave spherical socket having a surface opposing said surface of said ball;

there being fluid communication between said piston bore, said spherical joint and said swashplate upper surface;

said fluid-communication being provided by an internal fluid conduit of said ball, a groove arrangement, and an internal fluid conduit of said socket, said internal fluid conduit of said ball connected with said surface of said ball at an obtuse angle, said fluid conduit of said piston connecting said piston bore with said internal fluid conduit of said ball, said groove arrangement including a plurality of substantially circular grooves on said surface of one of said ball and said spherical socket, with said internal fluid conduit of said one of said ball and said spherical socket being directly connected with at least one of said circular grooves, said internal fluid conduit of said spherical socket connecting the interior and exterior of said spherical socket, and said internal fluid conduit being closely in fluid communication with said grooves when said spherical joint is substantially flexed.

3. An axial-piston pump as defined in claim 2, wherein said ball includes said plurality of grooves, and wherein at least one groove is located upon the surface of said spherical socket.

4. An axial-piston pump as defined in claim 2, wherein at least one of said grooves of said plurality of grooves is in connection with at least one other of said grooves through a passage.

5. An axial-piston pump as defined in claim 2, wherein at least one of said grooves is substantially helical in shape.

6. An axial piston pump as defined in claim 5, wherein at least one groove is located upon the surface of said spherical socket.

7. An axial-piston pump as defined in claim 2, wherein said grooves are located on the surface of said socket.

8. An axial-piston pump as defined in claim 2, wherein at least one groove is located on the surface of said ball and the plurality of grooves are located on the surface of said socket.

9. An axial-piston pump as defined in claim 4, wherein said grooves are located on the surface of said socket.

10. An axial-piston pump as defined in claim 5, wherein said grooves are located on the surface of said socket.

11. An axial-piston pump as defined in claim 6, wherein said grooves are located on the opposite spherical joint surface.

12. An axial-piston pump, comprising:

a rotatable shaft;

a rotatable cylinder barrel assembly having a cylinder barrel and a piston assembly received in a piston bore of said cylinder barrel;

a swashplate having an inclined upper surface for engaging said piston assembly;

said piston assembly including a piston connected to a shoe by a substantially spherical joint;

said substantially spherical joint comprising a ball having a surface and a substantially concave spherical socket having a surface opposing said surface of said ball;

said piston assembly having fluid communication between said piston bore, said spherical joint and said swashplate upper surface;

wherein said fluid-communication is provided by said ball having an internal fluid conduit connected with said surface of said ball, said piston containing a fluid conduit connecting said piston bore with said internal fluid conduit of said ball, said ball having a substantially circular groove on said surface thereof, the inner diameter of said circular groove on said surface of said ball being substantially greater than the outer diameter of said internal fluid conduit of said socket; said circular groove being directly connected with said internal fluid conduit of said ball, said spherical socket having a fluid conduit connecting the socket to a surface of the shoe, said spherical socket having a fluid passage, said internal fluid conduit of the socket being in direct connection with said fluid passage of the socket, said fluid passage of the socket being in fluid communication with said circular groove on said ball, and said internal fluid conduit of the socket being in fluid communication with said circular groove on said ball at least when said spherical joint is substantially flexed.

13. An axial-piston pump as defined in claim 12, wherein said groove is located on said socket and said fluid passage is located on said ball.

14. An axial-piston pump as defined in claim 2, wherein said ball is part of said shoe, and said socket is part of said piston.

15. An axial-piston pump as defined in claim 3, wherein said ball is part of said shoe, and said socket is part of said piston.

16. An axial-piston pump as defined in claim 4, wherein said ball is part of said shoe, and said socket is part of said piston.

17. An axial-piston pump as defined in claim 5, wherein said ball is part of said shoe, and said socket is part of said piston.

18. An axial-piston pump as defined in claim 6, wherein said ball is part of said shoe, and said socket is part of said piston.

19. An axial-piston pump as defined in claim 7, wherein said ball is part of said shoe, and said socket is part of said piston.

20. An axial-piston pump as defined in claim 8, wherein said ball is part of said shoe, and said socket is part of said piston.

21. An axial-piston pump as defined in claim 9, wherein said ball is part of said shoe, and said socket is part of said piston.

22. An axial-piston pump as defined in claim 10, wherein said ball is part of said shoe, and said socket is part of said piston.

23. An axial-piston pump as defined in claim 11, wherein said ball is part of said shoe, and said socket is part of said piston.

24. An axial-piston pump comprising:

a rotatable shaft;

a rotatable cylinder barrel assembly having a cylinder barrel and a piston assembly received in a piston bore of said cylinder barrel;

a swashplate having an inclined upper surface for engaging said piston assembly;

said piston assembly including a piston connected to a shoe by a substantially spherical joint;

each of said piston bores communicating with an associated notch in the cylinder barrel which provides relief in a radial direction at the end of the piston bore at the side of said swashplate;

said notches providing clearance for said shoe to be received deeper into said piston bore.

25. An axial-piston pump comprising;

a shaft rotatable about an axis;

a rotatable cylinder barrel assembly having a cylinder barrel and a piston assembly received in a piston bore of said cylinder barrel;

a swashplate having an inclined upper surface for engaging said piston assembly;

a piston assembly including a piston connected to a shoe by a substantially spherical joint;

a retainer plate having a lower surface that engages said shoe;

a retaining ring located within said retainer plate, said retaining ring and said retainer plate surrounding said shaft, said retaining ring cooperating with said retainer plate for retaining said shoe of said piston assembly on said swashplate upper surface;

said shoe having an axis of rotation;

said retainer plate and said retaining ring being movable normal to the axis of rotation of said shoe and rotating about the axis of rotation of said shaft.

26. An axial-piston pump as defined in claim 25, wherein said retaining ring has a shoulder for engaging an upper surface of said retainer plate.

27. An axial-piston pump as defined in claim 26, wherein said shoulder and said retainer plate upper surface are substantially spherical.

28. An axial-piston pump as defined in claim 27, wherein said shoe has an upper surface and a lower surface, and wherein said retainer plate lower surface, said shoe upper and lower surface and said swashplate upper surface are substantially spherical.

29. An axial-piston pump as defined in claim 28, wherein said swashplate upper surface has a centerline, and wherein the centerlines of the spherical surfaces of said swashplate, said shoe, said retainer plate and said retainer ring meet at a single point.

30. An axial-piston pump comprising:

a rotatable shaft;

a rotatable cylinder barrel assembly having a cylinder barrel and a piston assembly including a piston received in a piston bore of said cylinder barrel;

a swashplate having an inclined upper spherical surface for engaging said piston assembly;

a substantially spherical joint connecting said piston to a shoe;

a valve plate that engages a bore channel between said piston bore and the cylinder end opposite of said swashplate, said valve plate having ports therein for receiving and delivering fluid to and from said piston bore;

one of said ports and the bore channel openings connected with it create a pressure field, the centroid of said pressure field being spaced apart a distance from the centroid of the combined hydraulic forces of the piston bores connected with said port toward the direction of the centerline of said cylinder barrel;

said distance between said centroids of said pressure field and said combined hydraulic forces and the forces of said pressure field and said combined hydraulic forces causing a tilting moment at said cylinder barrel in a counter-clockwise direction;

said cylinder barrel having a cylinder barrel bearing with an equivalent force point spaced from said swashplate in a direction toward said cylinder barrel;

said shoe sliding on said spherical upper surface of said swashplate, transferring axial force of said piston into axial force of said shoe and radial force of said spherical joint;

said spherical joint radial force perpendicular to the plane of said pistons in dead-center positions, acts in the plane of said piston joint between said spherical upper surface of said swashplate and said equivalent force point of said cylinder barrel bearing;

said joint radial forces of said piston at said dead-center positions and lever arm between said plane of said piston joint and said equivalent force point of said cylinder barrel bearing causing a tilting moment at said cylinder barrel in a clockwise direction;

wherein the distance between the hydraulic force at said one port and the combined hydraulic forces of the piston bores connected with said one port cause a counter rotating moment, and the distance is selected so that said tilting moments at said cylinder barrel in said clockwise and said counter-clockwise direction nearly balance each other.

31. An axial-piston pump as defined in claim 30, wherein said bore channel is substantially angled toward the direction of rotation of said cylinder barrel.

32. An axial-piston pump as defined in claim 31, wherein the first section of said bore channel at the side of said valve plate is substantially parallel to the resulting flow velocity vector.

33. An axial-piston pump as defined in claim 30, wherein the direction of said channel is positioned such that the fluid flow in the direction of the centrifugal forces in said cylinder barrel is maximized.

34. An axial-piston pump as defined in claim 31, wherein the direction of said channel is positioned such that the fluid flow in the direction of the centrifugal forces in said cylinder barrel is maximized.

35. An axial-piston pump as defined in claim 32, wherein the direction of said channel is positioned such that the fluid flow in the direction of the centrifugal force s in said cylinder barrel is maximized.

36. An axial-piston pump as defined in claim 30, wherein the first section of said bore channel at the side of said valve plate is substantially trapezoidal.

37. An axial-piston pump as defined in claim 31, wherein the first section of said bore channel at the side of said valve plate is substantially trapezoidal.

38. An axial-piston pump as defined in claim 32, wherein the first section of said bore channel at the side of said valve plate is substantially trapezoidal.

39. An axial-piston pump as defined in claim 33, wherein the first section of said bore channel at the side of said valve plate is substantially trapezoidal.

40. An axial-piston pump as defined in claim 34, wherein the first section of said bore channel at the side of said valve plate is substantially trapezoidal.

41. An axial-piston pump as defined in claim 35, wherein the first section of said bore channel at the side of said valve plate is substantially trapezoidal.

42. An axial-piston pump comprising:

a rotatable shaft;

a rotatable cylinder barrel assembly having a cylinder barrel and a piston assembly received in a piston bore of said cylinder barrel;

a swashplate having an inclined upper surface for engaging said piston assembly;

a valve plate that engages a bore channel between said piston bore and cylinder end opposite of said swashplate, said valve plate having ports therein for receiving and delivering fluid to and from said piston bore;

wherein said bore channels are angled substantially in the direction of rotation of said cylinder barrel.

43. An axial-piston pump as defined in claim 42, wherein a first section of said bore channel at the side of said valve plate is substantially parallel to a flow velocity vector of the fluid flow in said bore channel.

44. An axial-piston pump as defined in claim 42, wherein said bore channels are angled substantially both in the rotational direction of said cylinder barrel and towards the rotational axis of said cylinder barrel.

45. An axial-piston pump comprising:

a rotatable shaft;

a rotatable cylinder barrel assembly having a cylinder barrel and a piston assembly including a plurality of pistons each received in a respective piston bore of said cylinder barrel;

a swashplate having an inclined upper surface for engaging said piston assembly;

a valve plate that engages a bore channel between said piston bore and cylinder end opposite of said swashplate, said valve plate having main ports therein for receiving and delivering fluid to and from said piston bores;

said valve plate having a plurality of compensating ports in fluid connection with one another, located near top and bottom dead-center positions, respectively, of said pistons in said piston bores.

46. An axial-piston pump as defined in claim 45, wherein said compensating ports and said main ports of said valve plate are spaced so that the paths between said main ports and said compensating ports nearly reflect the shape of said bore channel at the end of said cylinder barrel opposite to said swashplate.

47. An axial-piston pump comprising:

a rotatable shaft;

a rotatable cylinder barrel assembly having a cylinder barrel and a piston assembly including a plurality of pistons each received in a respective piston bore of said cylinder barrel;

a swashplate having an inclined upper surface for engaging said piston assembly;

said swashplate having a swashplate reciprocating mechanism defining first and second pivot axis, each defining first and second pivoting joints, said swashplate reciprocating mechanism reciprocating said swashplate about said first and second pivot axes which are located near the centerlines of the pistons in a dead-center position and substantially perpendicular to the plane of the centerlines of the pistons in top and bottom dead-center positions such that said pistons are received substantially to said bottom of said piston bores.

48. An axial-piston pump as defined in claim 47, wherein said swashplate reciprocating mechanism further comprises:

at least one first plunger bore, located near said plane of the centerline of said piston assembly in bottom dead-center position;

a first reciprocal plunger disposed in said first plunger bore; and a first linkage for linking said swashplate to said first plunger, defining one of said pivoting joints.

49. An axial-piston pump as defined in claim 48, wherein said first linkage includes a mechanical link between said first plunger and said swashplate that forms at least one pivoting joint of said first pivot axis;

a stop extending from said swashplate;

said mechanical link being restricted in its rotational movement by said stop.

50. An axial-piston pump as defined in claim 48, wherein said linkage includes a mechanical link that creates a first pivoting joint between said link and said first plunger and a second pivoting joint between said link and said swashplate;

a stop extending from said swashplate;

said mechanical link being restricted in its rotational movement by said stop.

51. An axial-piston pump as defined in claim 48, wherein said swashplate reciprocating mechanism further comprises:

at least one second plunger bore located near said plane of the centerline of said piston assembly in top dead-center position;

a second reciprocable plunger disposed in said second plunger bore;

a second linkage for linking said swashplate to said second plunger, defining one of said pivoting joints.

52. An axial-piston pump as defined in claim 51, wherein said first linkage includes a first mechanical link between said first plunger and said swashplate, and wherein said second linkage includes a second mechanical link between said second plunger and said swashplate.

53. An axial-piston pump as defined in claim 52, wherein the joints of said mechanical links of said swashplate are positioned that the combined axial forces of said pistons and said shoes connected to one valve plate port are located near or within the connecting lines of the forces of said joints.

54. An axial-piston pump comprising:

a rotatable shaft;

a rotatable cylinder barrel assembly having a cylinder barrel and a piston assembly including at least one piston received in a piston bore of said cylinder barrel;

a swashplate having an inclined upper spherical surface for engaging said piston assembly;

a substantially spherical joint connecting said piston to a shoe;

a valve plate that engages a bore channel between said piston bore and the cylinder end opposite of said swashplate, said valve plate having ports therein for receiving and delivering fluid to and from said piston bore;

one of said ports and the bore channel openings connected with it create a pressure field, the centroid of said pressure field being spaced apart a distance from the centroid of the combined hydraulic forces of the piston bore connected with said port toward the direction of the centerline of said cylinder barrel;

said distance between said centroids of said pressure field and said combined hydraulic forces and the forces of said pressure field and said combined hydraulic forces causing a tilting moment at said cylinder barrel in a counterclockwise direction;

said cylinder barrel having a cylinder barrel bearing with an equivalent force point spaced from said swashplate in direction toward said cylinder barrel; said shoe sliding on said spherical upper surface of said swashplate, transferring axial force of said piston into axial force of said shoe and radial force of said spherical joint;

said joint radial force, perpendicular to the plane of said piston in dead-center positions, acts in the plane of said piston joint between said spherical upper surface of said swashplate and said equivalent force point of said cylinder barrel bearing;

said joint radial forces of said piston at said dead-center positions and lever arm between said plane of said piston joint and said equivalent force point of said cylinder barrel bearing causing a tilting moment at said cylinder barrel in a clockwise direction;

wherein the distance between the hydraulic force at said one port and the combined hydraulic forces of the bores connected with said one port cause a counter rotating moment, and the distance is selected so that said tilting moments at said cylinder barrel in said clockwise and said counter-clockwise direction nearly balance each other.

55. An axial-piston pump as defined in claim 54, wherein said bore channel is substantially angled toward the direction of rotation of said cylinder barrel.

56. An axial-piston pump as defined in claim 54, wherein said first section of said bore channel is curved inwardly and in a circumferential direction.

57. An axial-piston pump as defined in claim 54, wherein the direction of said channel is selected such that the fluid flow in the direction of the centrifugal forces in said cylinder barrel are maximized.

* * * * *